US009516899B2

(12) United States Patent
Plojoux et al.

(10) Patent No.: US 9,516,899 B2
(45) Date of Patent: Dec. 13, 2016

(54) AEROSOL GENERATING DEVICE WITH IMPROVED TEMPERATURE DISTRIBUTION

(71) Applicant: Philip Morris Products S.A., Neuchatel (CH)

(72) Inventors: Julien Plojoux, Geneva (CH); Olivier Greim, Villars-Burquin (CH)

(73) Assignee: PHILIP MORRIS PRODUCTS S.A., Neuchatel (CH)

( * ) Notice: Subject to any disclaimer, the term of this patent is extended or adjusted under 35 U.S.C. 154(b) by 41 days.

(21) Appl. No.: 14/365,675

(22) PCT Filed: Dec. 28, 2012

(86) PCT No.: PCT/EP2012/077062

§ 371 (c)(1),
(2) Date: Jun. 16, 2014

(87) PCT Pub. No.: WO2013/098395

PCT Pub. Date: Jul. 4, 2013

(65) Prior Publication Data

US 2014/0305449 A1 Oct. 16, 2014

(30) Foreign Application Priority Data

Dec. 30, 2011 (EP) ..... 11196232

(51) Int. Cl.
*A24F 47/00* (2006.01)

(52) U.S. Cl.
CPC ..... *A24F 47/008* (2013.01); *A24F 47/002* (2013.01)

(58) Field of Classification Search
CPC ..... A24F 47/008; A24F 47/002
See application file for complete search history.

(56) References Cited

U.S. PATENT DOCUMENTS 5,666,977 A 9/1997 Higgins et al.
6,053,176 A 4/2000 Adams et al.
(Continued)

FOREIGN PATENT DOCUMENTS

CN 1491598 A 4/2004
CN 101277622 A 10/2008
(Continued)

OTHER PUBLICATIONS

Jack, Ecigarette Parts:Ohms Explained, Nov. 10, 2011 [downloaed on May 2, 2016 from archive.org date Feb. 19, 2012].*
(Continued)

*Primary Examiner* — Anthony Calandra
(74) *Attorney, Agent, or Firm* — Oblon, McClelland, Maier & Neustadt, L.L.P.

(57) ABSTRACT

There is provided an aerosol generating device configured to receive an aerosol-forming substrate and configured to heat the aerosol-forming substrate using both an internal heater, positioned within the substrate, and an external heater positioned outside of the substrate. The use of both an internal and an external heater allows each heater to operate at a lower temperature than would be required when using either an internal or external heater alone. By operating the external heater at a lower temperature than the internal heater, the substrate can be heated to have a relatively uniform temperature distribution while the external temperature of the device can be kept to an acceptably low level.

14 Claims, 4 Drawing Sheets

(56) References Cited

U.S. PATENT DOCUMENTS

| | | | | |
|---|---|---|---|---|
| 2008/0092912 | A1* | 4/2008 | Robinson | A24F 47/008 131/200 |
| 2011/0126848 | A1 | 6/2011 | Zuber et al. | |
| 2011/0155718 | A1 | 6/2011 | Greim et al. | |
| 2012/0145169 | A1* | 6/2012 | Wu | A24F 47/008 131/273 |
| 2014/0338680 | A1* | 11/2014 | Abramov | A24F 47/008 131/328 |

FOREIGN PATENT DOCUMENTS

| | | | |
|---|---|---|---|
| CN | 101557728 | A | 10/2009 |
| EP | 0 430 559 | A2 | 6/1991 |
| EP | 0 503 767 | A1 | 9/1992 |
| EP | 2 327 318 | A1 | 6/2011 |
| EP | 2 340 730 | A1 | 7/2011 |
| GB | 2473264 | A | 3/2011 |
| JP | H5-115272 | A | 5/1993 |
| WO | WO 99/20939 | A1 | 4/1999 |

OTHER PUBLICATIONS

International Search Report and Written Opinion of the International Searching Authority issued Jun. 3, 2013, in PCT/EP2012/077062, filed Dec. 28, 2012.

Combined Chinese Office Action and Search Report issued Aug. 28, 2015 in Patent Application No. 201280060098.9 (with English language translation).

Chinese Office Action and Search Report with English translation, mailed on May 16, 2016 in corresponding Chinese Patent Application No. 201280060098.9, (17 pages).

Japanese Notice of Allowance with English translation, mailed on Sep. 12, 2016 in corresponding Japanese Patent Application No. 2014-549489, citing document AO therein (6 pages).

* cited by examiner

AEROSOL GENERATING DEVICE WITH IMPROVED TEMPERATURE DISTRIBUTION

CROSS REFERENCE TO RELATED APPLICATION

This application is a national phase application based on PCT/EP2012/077062, filed on Dec. 28, 2012.

The present specification relates to a heated aerosol generating device and in particular to a heating arrangement and method for heating an aerosol-forming substrate within an aerosol generating device.

Aerosol generating devices in which an aerosol-forming substrate is heated to produce an aerosol are known in the art. For a given aerosol-forming substrate there is a range of acceptable temperatures to which it can be heated. It is important not to exceed a maximum temperature, above which undesirable combustion or pyrolysis may occur. However, below a minimum temperature the desired aerosol will not form. The substrate can be heated using heaters positioned externally of the substrate or internally of the substrate. Using an internal heater has the advantage that heat is provided efficiently to the substrate with less heat loss that with external heaters. However one issue with the use of an internal heater is that it is difficult to provide heat evenly throughout the substrate and so to heat the entire substrate to within the optimum temperature range.

It is desirable to heat an aerosol-forming substrate to have a uniform temperature distribution, or at least so that all of the substrate has a temperature within a desirable temperature range.

The present disclosure relates to an aerosol generating device configured to receive an aerosol-forming substrate and configured to heat the aerosol-forming substrate using both an internal heater, positioned within the substrate, and an external heater positioned outside of the substrate. The use of both an internal and an external heater allows each heater to operate at a lower temperature than would be required when using either an internal or external heater alone. By operating the external heater at a lower temperature than the internal heater, the substrate can be heated to have a relatively uniform temperature distribution while the external temperature of the device can be kept to an acceptably low level. This is a significant issue for handheld devices because, for example, if higher temperatures are required for heaters, dangerous or uncomfortable hot spots can arise during operation of an aerosol generating device In one embodiment, there is provided an aerosol generating device comprising: a substrate receiving cavity configured to receive an aerosol-forming substrate; an internal heater positioned within the substrate receiving cavity; an external heater positioned on a perimeter of the substrate receiving cavity; and a controller configured to control a supply of power to the internal heater or to the external heater, or to both the internal heater and the external heater, so that the external heater has a lower temperature than the internal heater. In use, the external heater may have a temperature lower than the temperature of the aerosol-forming substrate but higher than ambient temperature.

As used herein, an 'aerosol-generating device' relates to a device that interacts with an aerosol-forming substrate to generate an aerosol. The aerosol-forming substrate may be part of an aerosol-generating article, for example part of a smoking article. An aerosol-generating device may be a smoking device that interacts with an aerosol-forming substrate of an aerosol-generating article to generate an aerosol that is directly inhalable into a user's lungs thorough the user's mouth. An aerosol-generating device may be a holder.

As used herein, the term 'aerosol-forming substrate' relates to a substrate capable of releasing volatile compounds that can form an aerosol. Such volatile compounds may be released by heating the aerosol-forming substrate. An aerosol-forming substrate may conveniently be part of an aerosol-generating article or smoking article.

As used herein, the terms 'aerosol-generating article' and 'smoking article' refer to an article comprising an aerosol-forming substrate that is capable of releasing volatile compounds that can form an aerosol. For example, an aerosol-generating article may be a smoking article that generates an aerosol that is directly inhalable into a user's lungs through the user's mouth. An aerosol-generating article may be disposable. The term 'smoking article' is generally used hereafter. A smoking article may be, or may comprise, a tobacco stick.

The external heater may be shaped or controlled to provide, in conjunction with the internal heater, a substantially uniform temperature distribution around a perimeter of the cavity. The substantially uniform temperature distribution may be determined by various known methods, for example, the use of an infrared camera profiling or thermocouples. Other methods of determining the temperature distribution will be apparent to one of ordinary skill in the art. The most advantageous shape for the external heater depends on the shape of the internal heater as well as the shape of the aerosol-forming substrate. For example, the external heater may be shaped and positioned adjacent those portions of the aerosol-forming substrate furthest from, or receiving least heat from, the internal heater.

The external heater may advantageously be disposed substantially symmetrically around a perimeter of the substrate receiving cavity, particularly when the internal heater is disposed symmetrically or centrally within the substrate receiving cavity. The external heater may comprise one or more external heating elements. The term "external heating element" refers to one that at least partially surrounds the aerosol-forming substrate.

The internal heater may comprise an internal heating element, in the form of a blade, for at least partially inserting into the aerosol-forming substrate of the smoking article when the smoking article is received in the cavity. An "internal heating element" is one which is suitable for insertion into an aerosol-forming material.

The external heater may comprise two heating elements each extending partially around the perimeter of the cavity, and positioned to face the largest faces of an internal heating blade.

The controller may take the form of electronic circuitry arranged to be connected to a power supply and to one or both of the internal and external heater. The electronic circuitry may provide for the internal and external heaters to be independently controllable or for separate heating elements, forming part of the internal or external heater, to be independently controllable. The electronic circuitry may be programmable.

The controller may be configured to control the external heater to have a temperature between 100 and 200 degrees centigrade. The controller may be configured to control the internal heater to have a temperature between 320 and 420 degrees centigrade. In one embodiment, the controller will be configured such that the internal heater has an average temperature over the surface area of the internal heater being approximately 375 degrees centigrade and a maximum localized temperature being 420 degrees centigrade.

The aerosol-generating device may further comprise a housing containing the internal and external heaters. The housing may be designed to be grasped or held by a user.

The external heater may be spaced from the housing by an air gap or a layer of insulation. In particular, a support structure may be provided around the external heater, the support structure comprising an internal surface having one or more ribs or projections, the ribs or projections contacting the external heater. The support structure may be received within the housing or form part of the housing. By supporting the external heater on ribs or projections, thermal conduction from the external heater to the support structure and to the housing is relatively small. The external heater may be positioned on, or form, an inner surface of the cavity so that, in use, the external heater contacts the aerosol-forming substrate or an outer wrapper or casing of the aerosol-forming substrate. The external heater can then heat the aerosol-forming substrate directly by conduction. It will now be clear to one of ordinary skill in the art that although reference is made to a cavity for receiving an aerosol-forming substrate, the aerosol-forming substrate may be an element comprising a smoking article that comprises a rod including the aerosol-forming substrate as well as other elements such as filters and transfer portions. It will therefore also now be obvious to one of ordinary skill in the art that the external heater may be provided in the housing in such a manner so as to allow heating of the substrate through modification of the housing, external heater design, and the smoking article. The support structure may comprise a mesh or comprise a plurality of holes in order to provide a low thermal mass.

The external heater may be provided on a sleeve that is movable relative to the housing of the device. The aerosol-forming substrate may be received in the sleeve. The sleeve may be used to aid insertion and extraction of the aerosol-forming substrate to and from the device. The sleeve may comprise a sliding receptacle for receiving the substrate, the sliding receptacle being slidable between a first position and a second position. The first position of the sliding receptacle is an operating position in which the internal and external heaters can heat the aerosol-forming substrate to form the aerosol. The sleeve may include electrical contacts for connection of the external heater to a power supply in the device when the sleeve is in the first position.

The aerosol-generating device may still further comprise an air inlet. The aerosol-generating device may still further comprise an air outlet. The aerosol-generating device may still further comprise a condensation chamber for allowing the aerosol having the desired characteristics to form.

The aerosol-generating device may be an electrically heated smoking system and may comprise electric internal and external heaters.

The electric heater elements may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese-, gold- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required. Alternatively, the electric heaters may comprise one or more infra-red heating elements, photonic sources, or inductive heating elements.

The internal heater may take any suitable form. For example, the internal heater may take the form of a heating blade. Alternatively, the internal heater may take the form of a casing or substrate having different electro-conductive portions, or an electrically resistive metallic tube. Alternatively, the internal heater may be one or more heating needles or rods that run through the centre of the aerosol-forming substrate. Other alternatives include a heating wire or filament, for example a Ni—Cr (Nickel-Chromium), platinum, gold, silver, tungsten or alloy wire or a heating plate. Optionally, the internal heating element may be deposited in or on a rigid carrier material. In one such embodiment, the electrically resistive heater may be formed using a metal having a defined relationship between temperature and resistivity. In such an exemplary device, the metal may be formed as a track on a suitable insulating material, such as ceramic material, and then sandwiched in another insulating material, such as a glass. Heaters formed in this manner may be used to both heat and monitor the temperature of the heaters during operation.

The external heater may take any suitable form. For example, the external heater may take the form of one or more flexible heating foils on a dielectric substrate, such as polyimide. The flexible heating foils can be shaped to conform to the perimeter of the substrate receiving cavity. Alternatively, the external heater may take the form of a metallic grid or grids, a flexible printed circuit board, a moulded interconnect device (MID), ceramic heater, flexible carbon fibre heater or may be formed using a coating technique, such as plasma vapour deposition, on a suitable shaped substrate. The external heater may also be formed using a metal having a defined relationship between temperature and resistivity. In such an exemplary device, the metal may be formed as a track between two layers of suitable insulating materials. An external heater formed in this manner may be used to both heat and monitor the temperature of the external heater during operation. The external heater may be an inductive heater.

The internal or external heater may comprise a heat sink, or heat reservoir comprising a material capable of absorbing and storing heat and subsequently releasing the heat over time to the aerosol-forming substrate. The heat sink may be formed of any suitable material, such as a suitable metal or ceramic material. In one embodiment, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fibre, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, metal salt, a mixture of eutectic salts or an alloy. The heat sink or heat reservoir may be arranged such that it is directly in contact with the aerosol-forming substrate and can transfer the stored heat directly to the substrate. Alternatively, the heat stored in the heat sink or heat reservoir may be transferred to the aerosol-forming substrate by means of a heat conductor, such as a metallic tube.

The internal and external heaters advantageously heat the aerosol-forming substrate by means of conduction. The heaters may be at least partially in contact with the substrate, or the carrier on which the substrate is deposited. Alternatively, the heat from either the internal or external heater may be conducted to the substrate by means of a heat conductive element.

During operation, the aerosol-forming substrate may be completely contained within the aerosol-generating device. In that case, a user may puff on a mouthpiece of the aerosol-generating device. A mouthpiece may be any portion of the aerosol-generating device that is placed into a user's mouth in order to directly inhale an aerosol generated by the aerosol-generating article or aerosol-generating device. The aerosol is conveyed to the user's mouth through the mouthpiece. Alternatively, during operation a smoking article containing the aerosol-forming substrate may be partially contained within the aerosol-generating device. In that case, the user may puff directly on the smoking article or a mouthpiece of the smoking article.

The smoking article may be substantially cylindrical in shape. The smoking article may be substantially elongate. The smoking article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length.

The smoking article may have a total length between approximately 30 mm and approximately 100 mm. The smoking article may have an external diameter between approximately 5 mm and approximately 12 mm. The smoking article may comprise a filter plug. The filter plug may be located at the downstream end of the smoking article. The filter plug may be a cellulose acetate filter plug. The filter plug is approximately 7 mm in length in one embodiment, but may have a length of between approximately 5 mm to approximately 10 mm.

In one embodiment, the smoking article has a total length of approximately 45 mm. The smoking article may have an external diameter of approximately 7.2 mm. Further, the aerosol-forming substrate may have a length of approximately 10 mm. Alternatively, the aerosol-forming substrate may have a length of approximately 12 mm. Further, the diameter of the aerosol-forming substrate may be between approximately 5 mm and approximately 12 mm. The smoking article may comprise an outer paper wrapper. Further, the smoking article may comprise a separation between the aerosol-forming substrate and the filter plug. The separation may be approximately 18 mm, but may be in the range of approximately 5 mm to approximately 25 mm.

The aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. Optionally, the solid aerosol-forming substrate may contain additional tobacco or non-tobacco volatile flavour compounds, to be released upon heating of the substrate. The solid aerosol-forming substrate may also contain capsules that, for example, include the additional tobacco or non-tobacco volatile flavour compounds and such capsules may melt during heating of the solid aerosol-forming substrate.

As used herein, homogenised tobacco refers to material formed by agglomerating particulate tobacco. Homogenised tobacco may be in the form of a sheet. Homogenised tobacco material may have an aerosol-former content of greater than 5% on a dry weight basis. Homogenised tobacco material may alternatively have an aerosol former content of between 5% and 30% by weight on a dry weight basis. Sheets of homogenised tobacco material may be formed by agglomerating particulate tobacco obtained by grinding or otherwise comminuting one or both of tobacco leaf lamina and tobacco leaf stems. Alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

In a particularly preferred embodiment, the aerosol-forming substrate comprises a gathered crimpled sheet of homogenised tobacco material. As used herein, the term 'crimped sheet' denotes a sheet having a plurality of substantially parallel ridges or corrugations. Preferably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled. In certain embodiments, the aerosol-forming substrate may comprise a gathered sheet of homogenised tobacco material that is substantially evenly textured over substantially its entire surface. For example, the aerosol-forming substrate may comprise a gathered crimped sheet of homogenised tobacco material comprising a plurality of substantially parallel ridges or corrugations that are substantially evenly spaced-apart across the width of the sheet.

Optionally, the solid aerosol-forming substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix.

The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

Although reference is made to solid aerosol-forming substrates above, it will be clear to one of ordinary skill in the art that other forms of aerosol-forming substrate may be used with other embodiments. For example, the aerosol-forming substrate may be a liquid aerosol-forming substrate. If a liquid aerosol-forming substrate is provided, the aerosol-generating device preferably comprises means for retaining the liquid. For example, the liquid aerosol-forming substrate may be retained in a container. Alternatively or in addition, the liquid aerosol-forming substrate may be absorbed into a porous carrier material. The porous carrier material may be made from any suitable absorbent plug or body, for example, a foamed metal or plastics material, polypropylene, terylene, nylon fibres or ceramic. The liquid aerosol-forming substrate may be retained in the porous carrier material prior to use of the aerosol-generating device or alternatively, the liquid aerosol-forming substrate material may be released into the porous carrier material during, or immediately prior to use. For example, the liquid aerosol-forming substrate may be provided in a capsule. The shell of the capsule preferably melts upon heating and releases the liquid aerosol-forming substrate into the porous carrier material. The capsule may optionally contain a solid in combination with the liquid.

Alternatively, the carrier may be a non-woven fabric or fibre bundle into which tobacco components have been incorporated. The non-woven fabric or fibre bundle may comprise, for example, carbon fibres, natural cellulose fibres, or cellulose derivative fibres.

The aerosol-generating device may further comprise a power supply for supplying power to the internal and external heaters. The power supply may be any suitable power supply, for example a DC voltage source. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate or a Lithium-Polymer battery.

In one embodiment, the aerosol-generating device further comprises a sensor to detect air flow indicative of a user taking a puff which enables puff based activation of the electric heater or an improved energy management of the electric heater. The sensor may be any of: a mechanical device, an electro-mechanical device, an optical device, an opto-mechanical device and a micro electro-mechanical systems (MEMS) based sensor. In that embodiment, the sensor may be connected to the power supply and the system is arranged to activate the electric heater when the sensor senses a user taking a puff. In an alternative embodiment, the system further comprises a manually operable switch, for a user to initiate a puff or to enable a long-lasting smoking experience.

The aerosol-generating device is preferably a handheld aerosol-generating device that is comfortable for a user to hold between the fingers of a single hand. The aerosol-generating device may be substantially cylindrical in shape. The aerosol-generating device may have a polygonal cross section and a protruding button formed on one face: in this embodiment, the external diameter of the aerosol-generating device may be between about 12.7 mm and about 13.65 mm measured from a flat face to an opposing flat face; between about 13.4 mm and about 14.2 mm measured from an edge to an opposing edge (that is, from the intersection of two faces on one side of the aerosol-generating device to a corresponding intersection on the other side); and between about 14.2 mm and about 15 mm measured from a top of the button to an opposing bottom flat face. The length of the aerosol generating device may be between about 70 mm and 120 mm.

In another aspect, there is provided a method of heating an aerosol-forming substrate comprising: providing a first heater in an internal region of the aerosol forming substrate; providing a second heater on or near an exterior surface of the substrate; and controlling the temperature of the first heater and the second heater so that the second heater is at a lower temperature that the first heater.

The external heater may be controlled to have a temperature between 125 and 175 degrees centigrade. The internal heater may be controlled to have a temperature between 200 and 450 degrees centigrade. In use the external heater may have a temperature lower that the aerosol-forming substrate but higher than the ambient temperature.

The specification will be further described, by way of example only, with reference to the accompanying drawings, in which.

Figure 1:
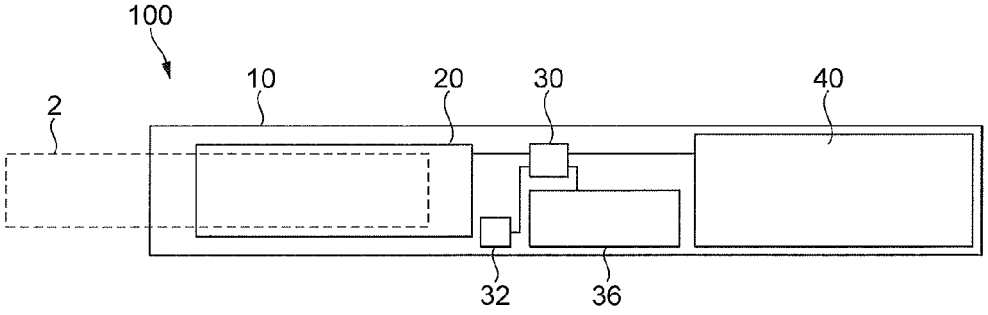
FIG. 1 is a schematic drawing showing the basic elements of an aerosol generating device in accordance with one embodiment.
Figure 2:
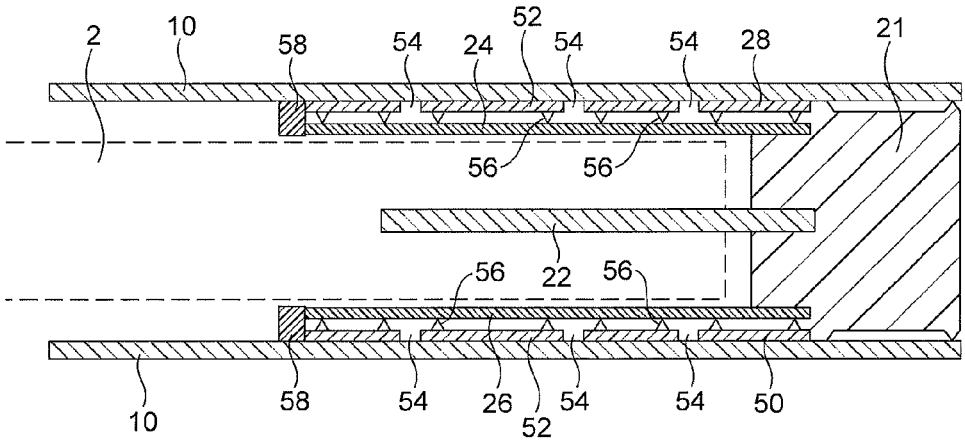
FIG. 2 is a schematic longitudinal cross section of a heater arrangement in accordance with one embodiment.
Figure 3A:
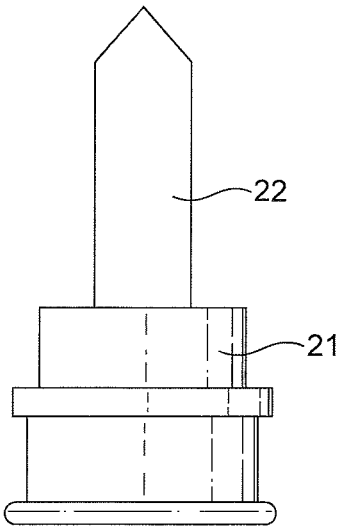
Figure 3B:
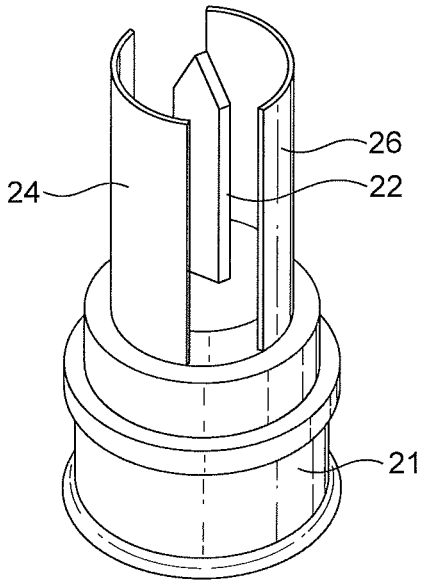
Figure 3C:
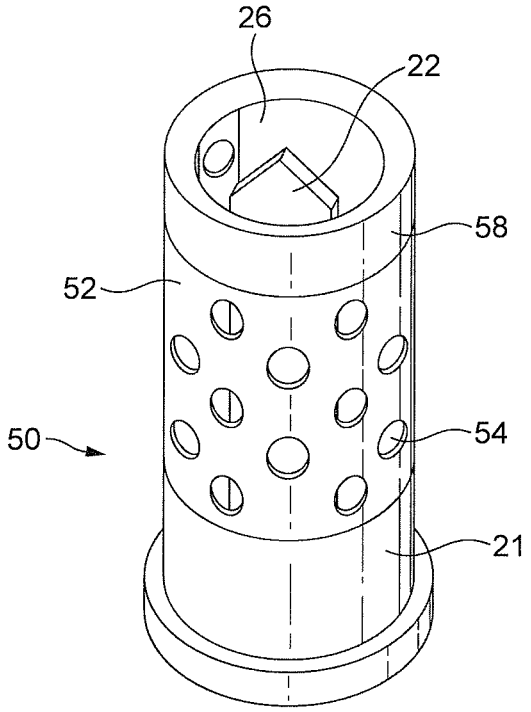
Figure 4:
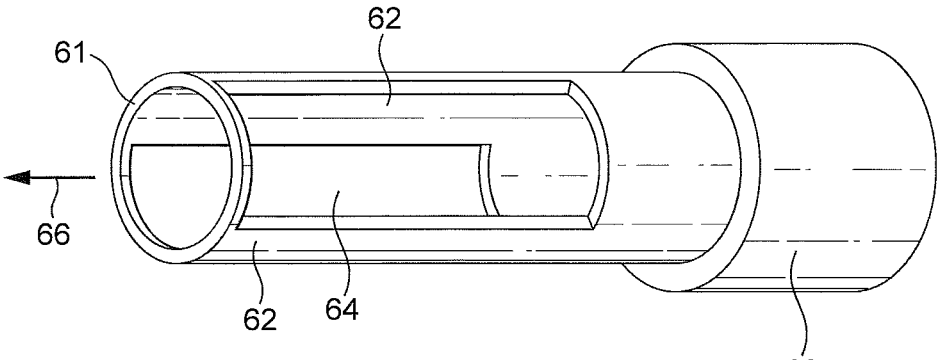
Figure 5:
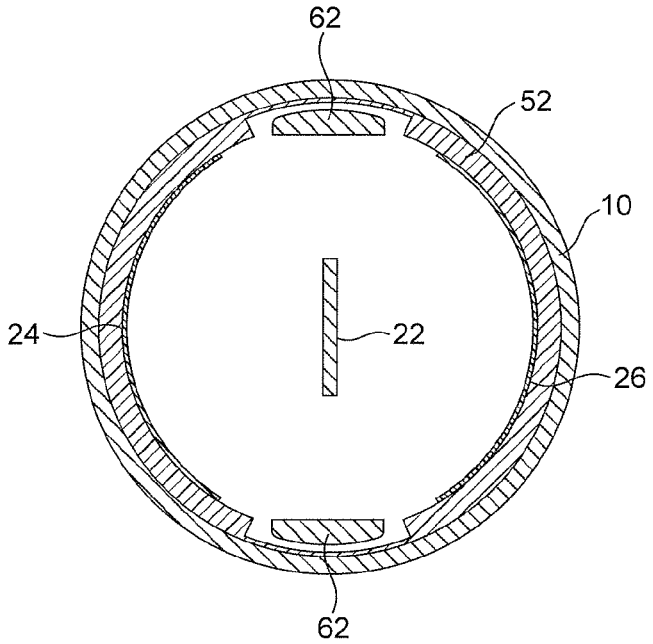
Figure 6:
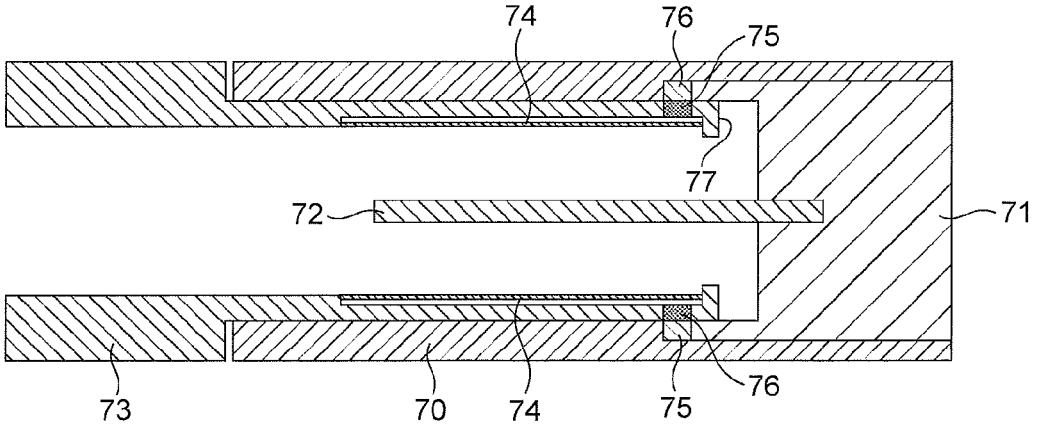

FIG. 3*a* shows the internal heater element of FIG. 2;

FIG. 3*b* shows the internal and external heater elements of FIG. 2;

FIG. 3*c* shows the arrangement of FIG. 3*b* with a support structure included;

FIG. 4 shows a substrate extractor for use in a device of the type shown in FIG. 1;

FIG. 5 is a schematic radial cross section of the arrangement of FIG. 2 with an extractor as shown in FIG. 4 inserted; and FIG. 6 is a schematic longitudinal section of a heater arrangement in which the external heater elements are part of a substrate extractor, in accordance with another embodiment.

In FIG. 1, the inside of an embodiment of an electrically heated aerosol generating system 100 is shown in a simplified manner. Particularly, the elements of the electrically heated aerosol generating system 100 are not drawn to scale in FIG. 1. Elements that are not relevant for the understanding of this embodiment have been omitted to simplify FIG. 1.

The electrically heated aerosol generating system 100 comprises a housing 10 and an aerosol-forming substrate 2, for example a cigarette. The aerosol-forming substrate 2 is pushed inside the housing 10 to come into thermal proximity with the heater 20. The aerosol-forming substrate 2 will release a range of volatile compounds at different temperatures. Some of the volatile compounds released from the aerosol-forming substrate 2 are only formed through the heating process. Each volatile compound will be released above a characteristic release temperature. By controlling the maximum operation temperature of the electrically heated aerosol generating system 100 to be below the release temperature of some of the volatile compounds, the release or formation of these smoke constituents can be avoided.

Additionally, the housing 10 comprises an electrical energy supply 40, for example a rechargeable lithium ion battery. A controller 30 is connected to the heater 20, the electrical energy supply 40, an aerosol-forming substrate detector 32 and a graphical user interface 36, for example a display. The controller 30 controls the power supplied to the heater 20 in order to regulate its temperature. Typically the aerosol-forming substrate is heated to a temperature of between 250 and 450 degrees centigrade.

The aerosol-forming substrate detector 32 may detect the presence and identity of an aerosol-forming substrate 2 in thermal proximity with the heater 20 and signals the presence of an aerosol-forming substrate 2 to the controller 30.

The controller 30 controls the user interface 36 to display system information, for example, battery power, temperature, status of aerosol-forming substrate 2, other messages or combinations thereof.

FIG. 2 is a schematic sectional view of the heater arrangement in accordance with one embodiment. FIG. 2 shows only a front portion of the device, into which the substrate is inserted. The housing is open ended and defines a substrate receiving cavity into which an aerosol-forming substrate 2 (shown in dotted line) can be inserted. The cavity is configured to receive a cylindrical substrate in the form of a smoking article on which a user puffs.

The heater comprises three separate heater elements, an internal heater element 22 and two external heater elements 24, 26. The internal heater 22 is in the form of a blade supported in a base 21, and is shown more clearly in FIG. 3*a*. The internal heater element 22 is configured to be received inside the substrate. The external heater elements 24 and 26, shown more clearly in FIG. 3*b*, are arranged close to or in contact with the external surface of the smoking article. The external heater elements 24, 26 have an arcuate cross-section and extend around the perimeter of the cavity.

The external heaters are mounted within a support structure 50 within the housing 10. The support structure is more clearly shown in FIG. 3*c* and comprises a cylindrical shell 52 having a plurality of holes 54 formed in it. The external heater elements 24 and 26 are supported on a helical internal rib structure 56 on the shell in order to minimise conductive losses from the heater elements 24, 26 to the support structure 50 and housing 10. A cap structure 58 is provided to secure the heaters in place.

FIGS. 3*a* shows the internal heater element 22 in the supporting base 21. The internal heater is in the form of a blade formed of ceramic material on which platinum tracks are deposited. The heater is activated by passing a voltage across the platinum tracks. The blade is shaped for easy insertion and removal from an aerosol-forming substrate 2.

FIG. 3*b* is a perspective view of the internal heater element 22 of FIG. 3*a*, with the external heater elements 24, 26 positioned around it and a portion of the base 21. As shown in FIG. 3*b*, the external heater elements are formed from curved or arcuate sheets that extend around the perimeter of the substrate receiving cavity. The external heater elements are formed from flexible polyimide sheets between which resistive heating tracks are formed. Flexible heaters of this type are available from Minco of 7300 Commerce Lane, Minneapolis, Minn. 55432, U.S.A.

The external heater elements shown in FIG. 3*b* do not extend around the entire perimeter of the cavity but are positioned to match the shape of the internal heater element 22. The external heater elements are positioned and shaped to cover the regions of the perimeter of the cavity furthest from the internal heater element in order to provide as uniform a temperature distribution within the cavity as possible. However, this can also be achieved by providing one or more external heater elements around the entire perimeter of the cavity and controlling the power supplied to different sections of the external heater elements to obtain the most uniform temperature distribution possible. It is of course also possible to use a differently shaped internal heater element or elements.

The electrical connection of the internal and external heater elements to a power source are not shown, for clarity. However, it should be clear that both internal and external heater elements are electrically connected to the controller 30 and to the battery 40.

FIG. 3*c* shows the heater arrangement of FIG. 3*b* with the support structure 50 positioned around the external heater elements 24, 26. The support structure comprises a cylindrical shell 52 formed of a thermoplastic such PEEK or other suitable temperature resistant material. Holes 54 are formed through the shell in order to reduce its mass, and in particular its thermal mass. As described the shell 52 has a patterned internal surface, in this example an internal helical rib, that supports the external heater elements while minimising thermal contact. This cannot be seen in FIG. 3*c*. The shell 52 fits over base 21. A cap 58, also formed from a heat resistant material, such as a plastic or ceramic, is fitted on the top of the shell and the external heater elements 24, 26 to complete the support structure. In general, any material that has a sufficiently high melting/degradation temperature that prevents the release of undesirable, volatile compounds may be used.

In use, the internal heater element 22 is controlled to have a higher temperature than the external heater elements. In this embodiment, the internal heater element is controlled to have a maximum temperature of 350 degrees centigrade and during use is maintained close to that maximum temperature. The external heater elements 24, 26 are controlled to have a maximum temperature of 150 degrees centigrade and in use are maintained close to that maximum temperature.

The external heaters 24, 26 provide a form of active insulation. In other words, they reduce the thermal gradient across the heated substrate. In use, the aerosol-forming substrate typically reaches a temperature much higher than the external heater elements, but by reducing the thermal gradient across the substrate a more uniform heating of the substrate can be achieved, and a lower temperature for the internal heater element can be used.

FIG. 4 shows an extractor sleeve 60 that can be used in a device of the type shown in FIGS. 1 and 2. The extractor sleeve aids insertion and extraction of the aerosol-forming substrate to and from the device. The extractor sleeve is hollow and holds a cylindrical aerosol-forming substrate. The extractor sleeve is open at both ends, to allow both insertion of the substrate into the sleeve from a top end and insertion of the internal heater 22 into the substrate from a bottom end. A lip 61 may be formed on the bottom end of the extractor sleeve 60 to retain the substrate during an extraction process. The extractor sleeve is configured to be inserted into the substrate receiving cavity in the direction of arrow 66.

The aerosol-forming substrate is positioned in the region of legs 62 and windows 64 in the extractor. The windows 64 are shaped to correspond to the external heaters 24, 26. The windows 64 may be simply apertures in the extractor sleeve or may be formed from a thermally conductive material such as aluminium.

FIG. 5 is a schematic radial cross-section of a device of the type shown in FIG. 2 with the extractor sleeve inserted. The legs 62 of the extractor sleeve are shown positioned in the spaces between the external heater elements 24, 26. It can also be seen that the support sleeve 52 for the external heater elements has cut out portions for receiving the legs of the extractor sleeve. This allows the external heater elements to contact or be positioned very close to the aerosol-forming substrate in use.

In another embodiment, the external heater can be formed as part of an extractor sleeve of the type shown in FIG. 4. This is illustrated schematically in FIG. 6. FIG. 6 shows the housing 70 of an aerosol generating device defining a cavity into which an aerosol-forming substrate can be inserted. Within the cavity there is an internal heater 72, in the form of a blade as shown in FIG. 3*a*, supported in a base 71. An extractor sleeve 73 is inserted into the cavity. The extractor sleeve is a substantially hollow, tubular structure with a retaining lip 77 formed on one end. The extractor sleeve retains a cylindrical aerosol-forming substrate (not shown) and may be slid in and out of the cavity. The lip 77 retains the cylindrical aerosol-forming substrate as the sleeve 73 is withdrawn from the cavity.

Internal heater element 74 is formed on an interior surface of the sleeve 73 and extends around the circumference of the sleeve. The internal heater elements are electrically resistive tracks formed on the extractor sleeve and may be made from platinum. In order to provide electrical power to the external heater element 74 electrical contacts 75 are provided that provide an electrical connection between the resistive tracks on the interior surface of the sleeve 73 and a contact area on an external surface of the sleeve 73. The contacts 75 contact housing contacts 76 when the sleeve 73 is in a fully inserted position. Housing contacts 76 are electrically connected to a controller and a battery within the aerosol generating device, as described with reference to FIG. 1.

As described with reference to the previous embodiment, the external heater may be formed from one or a plurality of separate heater elements and may be shaped or controlled to correspond to the shape of the internal heater element or elements.

The exemplary embodiments described above illustrate but are not limiting. In view of the above discussed exemplary embodiments, other embodiments consistent with the above exemplary embodiments will now be apparent to one of ordinary skill in the art.

The invention claimed is:

1. An aerosol generating device, comprising:

a substrate receiving cavity configured to receive an aerosol-forming substrate;

an internal heater positioned within the substrate receiving cavity;

an external heater positioned on a perimeter of the substrate receiving cavity;

and a controller configured to control a supply of power to the internal heater or to the external heater, or to both the internal heater and the external heater, so that the external heater is operated at a lower temperature than the internal heater;

wherein the external heater is provided on a sleeve that is slidable relative to a housing of the device.

2. The aerosol generating device according to claim 1, wherein the external heater is shaped or controlled to provide, in conjunction with the internal heater, a substantially uniform temperature distribution around a perimeter of the cavity.

3. The aerosol generating device according to claim 1, wherein the controller is configured to control the external heater to have a temperature between 100 and 200 degrees centigrade.

4. The aerosol generating device according to claim 1, wherein the controller is configured to control the internal heater to have a temperature between 320 and 420 degrees centigrade.

5. The aerosol generating device according to claim 1, wherein the external heater is disposed substantially symmetrically around a perimeter of the substrate receiving cavity.

6. The aerosol generating device according to claim 1, wherein the external heater comprises a plurality of external heater elements.

7. The aerosol generating device according to claim 6, wherein the external heater comprises two heater elements each extending partially around the perimeter of the cavity.

8. The aerosol generating device according to claim 1, configured such that, in use, the external heater has a temperature lower than the aerosol-forming substrate but higher than ambient temperature.

9. The aerosol generating device according to claim 1, further comprising a support structure around the external heater, the support structure comprising an internal surface having one or more ribs or projections, the ribs or projections contacting the external heater.

10. The aerosol generating device according to claim 1, wherein the external heater is positioned on or forms an inner surface of the cavity so that, in use, the external heater contacts the aerosol-forming substrate.

11. The aerosol generating device according to claim 1, wherein the device is an electrically heated smoking device.

12. A method of heating an aerosol-forming substrate, comprising:

providing a first heater configured to contact an internal region of the aerosol forming substrate in a device;

providing a second heater configured to contact an exterior surface of the substrate; and providing a controller configured to control the temperature of the first heater and the second heater so that the second heater is operated at a lower temperature than the first heater;

wherein the second heater is provided on a sleeve that is slidable relative to a housing of the device.

13. The method according to claim 12, wherein the second heater is controlled to have a temperature between 100 and 200 degrees centigrade.

14. The method according to claim 12, wherein the first heater is controlled to have a temperature between 320 and 420 degrees centigrade.

* * * * *